US006099610A

United States Patent [19]

Palmer

[11] Patent Number: 6,099,610

[45] Date of Patent: Aug. 8, 2000

[54] AUTOMATICALLY EMPTYING CENTRAL VACUUM CLEANING APPARATUS

[76] Inventor: Willis Palmer, 1825 Sunset Dr., Vista, Calif. 92083

[21] Appl. No.: 09/174,634

[22] Filed: Oct. 19, 1998

[51] Int. Cl.[7] ..... B01D 46/00

[52] U.S. Cl. ..... 55/429; 55/432; 55/467; 137/527.8; 251/65

[58] Field of Search ..... 55/428, 429, 430, 55/432, 467, 473, DIG. 3; 251/65; 137/527.8; 222/58

[56] References Cited

U.S. PATENT DOCUMENTS

| | | | |
|---|---|---|---|
| 1,417,052 | 5/1922 | Gasteiger | 55/430 |
| 2,082,543 | 6/1937 | Hillman | 137/527.8 |
| 2,812,217 | 11/1957 | Koch et al. | 55/432 |
| 2,838,062 | 6/1958 | Held et al. | 137/527.8 |
| 2,878,893 | 3/1959 | Madsen | 55/432 |
| 3,135,427 | 6/1964 | Siegburg | 137/527.8 |
| 3,173,164 | 3/1965 | Congdon | 55/432 |
| 3,268,124 | 8/1966 | Weber | 55/432 |
| 3,307,576 | 3/1967 | Himes et al. | 137/527.8 |
| 3,318,327 | 5/1967 | Himes et al. | 137/527.8 |
| 3,360,005 | 12/1967 | Spoher et al. | 251/65 |
| 3,524,681 | 8/1970 | Boon | 55/432 |
| 3,528,453 | 9/1970 | Dunkelis | 251/65 |
| 3,541,945 | 11/1970 | Wexler | 251/65 |
| 3,780,502 | 12/1973 | Dupre et al. | 55/432 |
| 4,194,262 | 3/1980 | Finley et al. | 55/432 |
| 4,494,564 | 1/1985 | Lukacz | 137/527.8 |
| 5,273,362 | 12/1993 | Sneehan | 55/432 |
| 5,740,834 | 4/1998 | Sherowski | 137/527.8 |

*Primary Examiner*—Duane S. Smith
*Attorney, Agent, or Firm*—Frank D. Gilliam

[57] ABSTRACT

A central vacuum system particularly adapted to collect and dispose of hair from hair cutting and from pet grooming. The system includes an automatic arrangement for collecting and dumping accumulated hair or other material. A housing includes an inlet for receiving air and an air pump for expelling air from the housing, with filters between the inlet and air pump. A disposal opening is provided at the lower end of the housing for dumping accumulated material. A hinge is mounted on the housing adjacent to said disposal opening. A cover and extended arm are mounted on said hinge for rotation between a collection position with the cover over the disposal opening and an open position for dumping. A counterweight is mounted on the arm for maintaining the cover over the disposal opening when less than a predetermined weight of material rests on said cover within said housing and for allowing the cover to rotate away from the disposal opening when a greater weight of material is present. A magnet may be provided between the rotating assembly and the housing to further add a closing force to the cover.

11 Claims, 1 Drawing Sheet

AUTOMATICALLY EMPTYING CENTRAL VACUUM CLEANING APPARATUS

FIELD OF THE INVENTION

This invention relates to central vacuum cleaning systems in which air containing material such as hair clippings is drawn into a central container from which the material is removed for disposal.

BACKGROUND OF THE INVENTION

A wide variety of vacuum cleaning systems have been developed, including hand held devices for cleaning carpets and the like to central systems having a central container connected through conduits to a number of outlets to which flexible hoses can be connected for vacuum cleaning areas.

One problem with prior central cleaning systems is the need to periodically check the central container to determine whether it has filled to the point where efficiency is significantly reduced and the container must be emptied. Regular checking the container is time consuming and failure to empty the container will reduce efficiency and could damage the system. Further, emptying the container is often difficult and may cause dust and the like to be expelled into the air or spilled. For people allergic to some components of household or industrial dust or where the dust may include otherwise toxic material, this stirring up the collected material can have very adverse consequences.

Barber shops and pet grooming facilities have a particular need for efficient means for collecting hair clippings. Allowing the clippings to accumulate on the floor is unsightly. Frequent sweeping is time consuming and tends to put fine clippings, mites dandruff, etc. back into the air. Many people are allergic to cat and dog dandruff or hair. Further, clippings could carry disease organisms, lice and the like. Therefore, breathing air contaminated with hair clippings, whether human or animal is very undesirable.

Some hair cutting and animal grooming establishments use vacuum cleaners for collecting clippings. Portable units often pass very fine dust back into the air. Central units require regular checking and manual emptying, both of which consume time and cause problems, as mentioned above.

Many barbers, hair stylists and animal groomers now use clippers and the like having a vacuum hose connected to the cutting instrument, so that most if not all clippings are immediately pulled through a conduit to a central vacuum system. These systems substantially prevent clippings dropping into a persons clothing and allergens from entering the air. With these systems, for efficient operation the central collection container must be checked often and not be allowed be overfill. And, the problems of manually emptying the collected material remain.

Therefore, there is a continuing need for improved central vacuum systems, particularly for use by persons cutting human hair or grooming animals, which eliminate the need to constantly check the fill level of the central collection container and the need to manually empty the collection container.

SUMMARY OF THE INVENTION

The above-noted problems, and others, are overcome by an improved central vacuum cleaning system which basically comprises a housing that can be mounted on a wall or stand a predetermined distance above a floor, at least one inlet conduit connected to a first opening in the housing, at least one air pump connected to a second housing opening for drawing air in through the inlet conduit and exhausting air and a disposal opening covered by an automatically opening cover for emptying the housing when the collected material reaches a predetermined weight.

The automatic emptying system includes a cover hinged near one edge to move from a position closing the disposal opening and emptying position fully uncovering the disposal opening. An arm extends from the cover, preferably approximately in the same plane as the cover but on the opposite side of the hinge. A counterweight is mounted on the arm to bias the cover towards the closed position.

When the air pump is operating, a vacuum is drawn within the container, holding the cover closed so that air only enters through the air receiving conduit(s). When the air pump is shut off and relatively little material (dust, hair, etc.) has accumulated in the housing, the weight of the material will be insufficient to overcome the counterweight closing force, so the cover will remain closed. If more than a predetermined weight of material has accumulated, that weight will overcome the counterweight forces and the cover will swing away from the disposal opening. A conventional trash can or other container below the housing will catch the material and hold it for removal. Preferably, the trash can will be lined with a large plastic bag that can be tied and removed without exposing the person to the material.

While a small amount of dust will be stirred up when the housing is emptied, since the housing will ordinarily be in a closet or outdoors, with no people nearby, the small amount of dust can simply be allowed to settle. If desired, however, to fully contain the dust, a large plastic bag in the trash can extend up over the exterior of the housing and be secured to the housing by tape or the like. When the bag is sufficiently full and dust between housing and material surface in the bag has had time to settle, a person can remove the tape or other fastener, tie the bag closed and remove it for disposal. Since with a large bag disposal of the bag will be infrequent, the dust can be allowed to settle overnight, with the bag disposed of in the morning at the start of business.

To aid in securing the cover in the closed position until a sufficient quantity of material has collected, a magnetic latch means is preferably included. A short extension is secured to the cover or arm and extends along a side surface of the housing. A fitting is secured to the housing in a position nearly touching the extension when the cover is closed, such that the extension will swing away from the fitting when the cover opens. A magnet is secured to one of the extension and fitting and the other is formed from a magnetic material. The magnet (a permanent or electromagnet, as desired) will aid in holding the cover closed until the predetermined quantity of material has accummulated. When the cover has moved only a short distance, the magnetic field will quickly drop to zero, so that the cover will not be restricted against fully opening.

For best results, the counterweight will be secured to the arm with most of the counterweight mass (preferably from 60 to 100 per cent) extending above the arm. The counterweight is positioned close enough to the hinge that as the cover opens, the counterweight will at least partially (but not fully) pass above the hinge line, so that the downward force of the counter weight will be greatly reduced and the cover will fully open. Without this arrangement, the cover may hang up partially open as part of the material slides out and the counterweight and material forces tend to equalize.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
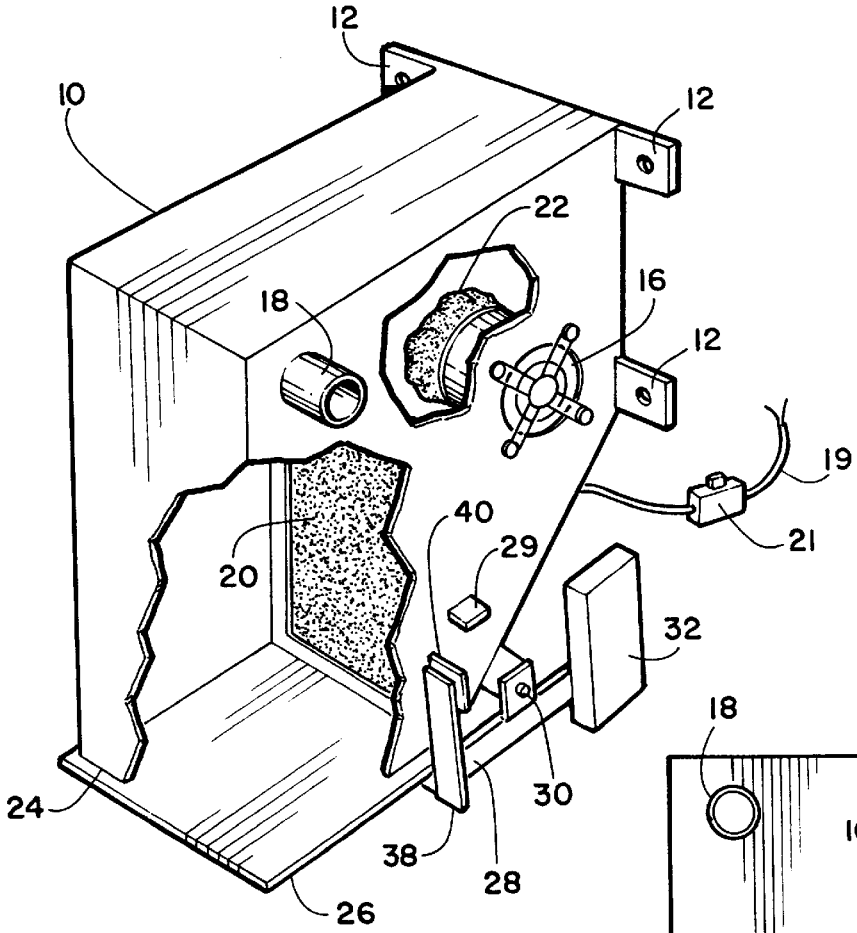
FIG. 1 is a perspective view of the central vacuum system, in partially cut away to show internal components.

As seen in the Figures, the system components are in and on a housing 10. Housing 10 may have any suitable configuration and may be made from any suitable material. The generally rectangular shape shown is convenient for installing on a wall or stand and heavy sheet metal provides a sturdy housing. Mounting ears 12 are provided for mounting housing 10 at a desired height on wall 14 or any convenient stand.

At least one conventional air pump 16 is mounted in an opening in a wall of housing 10 for drawing air in through inlet conduit 18 and expelling the cleaned air into the adjacent area. While generally a single pump 16 is sufficient, in large installations where a number of different conduits or hoses are connected to one or more inlets 18, two or more air pumps may be used. Pump(s) 16 are powered through a power cord 19 having a switch (not seen) in the vicinity of the use end of any conduits connected to inlet 18. Where several conduits are provided for use by different persons, conventional switches arranged so that any switch can turn the system on and the system will be off when all switches are off are provided. If desired, a master switch 21 may be provided on or near housing 10 to turn the entire system off, such as at the end of a work day.

A conventional large panel type filter 20 is provided between the material collection volume (to the left in FIG. 1) and the volume containing air pump 16. Preferably, a "sock" type filter 22 is also provided over the intake side of air pump 16. Any suitable conventional high efficiency filter material may be used in filters 20 and 22.

A large disposal opening 24 is provided in the lowermost end of the material collection volume. For best results, the walls of the collection volume are vertical with a full width opening 24 so that all material will be quickly dumped and any jams are avoided, which could happen with a tapered container.

Figure 2:
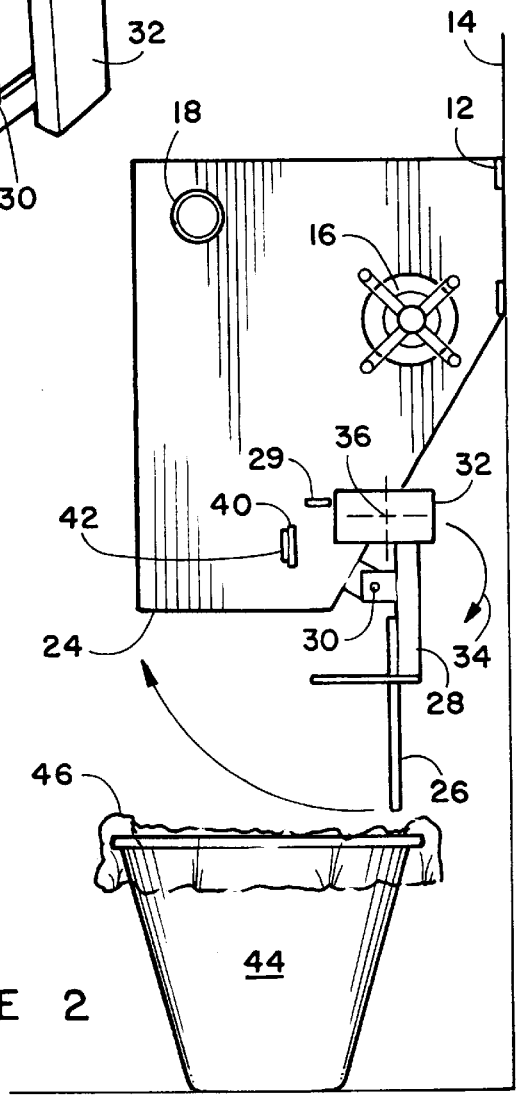
FIG. 2 is a side elevation view of the central vacuum system showing the disposal sequence.

A cover 26 and arm 28 are secured together and hinged by a hinge 30 to move the cover from a collection position closing opening to a fully open position as seen in FIG. 2 where flow of material out of housing 10 is totally unobstructed.

A counterweight 32 is mounted on arm 28 to return cover 26 to the closed position after dumping material, as indicated by arrow 34. The mass, position and moment arm of counterweight 32 will be selected to allow full opening of cover 26 while promptly returning the cover to the closed position and hold the cover closed until a predetermined weight of material has collected in housing 10. To prevent arm 28 and counterweight 32 from swinging over center at the fully opened position, a stop 29 is mounted on housing 10 to engage counterweight at the full open position.

Opening and closing actions are greatly facilitated where the mass of counterweight lies from about 60 to 100 per cent above the approximate plane of cover 26 (which is preferably flat, but could be curved somewhat if desired) and the distance between the center of rotation of hinge 30 and the plane of cover 26 is such that the center of mass 36 of counterweight 32 is slightly to the right of the center of hinge rotation as seen in FIG. 2. Most of the mass of counterweight 32 will pass over the center of rotation as cover 26 approaches the fully open position.

With this optimum arrangement, the full force of counterweight 32 will be applied when cover 26 first opens, and the opening force will decrease as the cover fully opens, so that opening will not be slowed as the material leaves housing 10 leaving a lessening weight on the cover. Of course, the center of mass 36 must be at least slightly to the right (FIG. 2) of the hinge center of rotation to allow the counterweight to close cover 26 after all material has been dumped. Counter weight force increases as cover 26 closes, assuring a tight closure. This arrangement prevents cover 26 from hanging up in a partially open position.

To provide a further force holding cover 26 closed, while not impeding opening, an extension 38 may be provided extending from the edge of cover 26 or arm 28 along housing 10. A fitting 40 is mounted on housing such that the distal end of extension 38 will nearly contact the fitting. A small magnet 42 is mounted on one of fitting 40 and extension 38 and the other is formed from a magnetic material attracted to the magnet. When cover 26 is closed, the magnet will exert a maximum magnetic closing force, resisting forces of the material accumulating in housing 10. When the predetermined amount of material has collected, the closing forces of counterweight 32 and magnet 42 will be overcome. When magnet 42 is separated only slightly from the cooperating magnetic material, magnetic forces will drop rapidly, so the magnet will not hinder full opening of cover 26.

Any suitable container 44 may be positioned below housing 10 to catch material falling from housing 10. Typically, a conventional trash container, a 55 gallon drum with top removed, etc may be used. Where the entire container 44 is not to be removed for disposal of the collected material, a plastic bag 46 preferably lines container 44. Then when bag 46 is full, it can be tied, removed and disposed of. If it is desired to limit dust in the room containing housing 10 to the maximum extent, plastic bag 44 could be very large and could extend up over housing 10 and be sealed thereto, such as just below air pump 16 with tape or other fastener. To dispose of the large bag 46, it would be untaped, tied, removed and replaced with an empty bag.

While certain specific relationships, materials and other parameters have been detailed in the above description of preferred embodiments, those can be varied, where suitable, with similar results. Other applications, variation and ramifications of the present invention will occur to those skilled in the art upon reading the present disclosure. Those are intended to be included within the scope of this invention as defined in the appended claims.

I claim:

1. A central vacuum system for collecting and disposing of material such as hair and other debris which comprises:

a housing;

support means for maintaining said housing at a predetermined height;

an inlet conduit for receiving air flow connected to a first opening in said housing;

air pump means connected to a second opening is said housing for expelling air from said housing;

filter means between said first and second openings;

a disposal opening in an end of said housing that is lowermost when said housing is supported by said support means;

hinge means mounted on said housing adjacent to said disposal opening;

cover means for closing said disposal opening, secured to said hinge means and extending in a first direction;

an arm extending from said hinge means in a second direction; and a counterweight on said arm for maintaining said cover over said disposal opening when less than a predetermined weight of material rests on said cover within said housing, from about 60 to 100 per cent of said counterweight extends above said arm and said counterweight is spaced from said hinge a predetermined distance such that said counterweight will pass partially above said hinge as said cover is opening to lessen the cover closing force as said cover approaches a fully open position;

whereby as material accumulates in said housing on said cover, when said predetermined weight is exceeded and said air pump means is turned off said cover will pivot downwardly to dump accumulated material.

2. The central vacuum system according to claim 1, further including disposable container means positioned below said cover to receive dumped material.

3. The central vacuum system according to claim 1, further including:

an extension fastened to one of said cover and said arm, extending adjacent to said housing;

a fitting on said housing closely adjacent to said extension when said cover is closed; and a magnet mounted on one of said extension and fitting and in contact with the other and the other of said extension and fitting being formed from a magnetic material;

whereby magnetic attraction in the cover closed position will aid in maintaining said cover in said closed position until said predetermined weight has accumulated on said cover.

4. The central vacuum system according to claim 1, further including a panel filter in said housing for separating a material retaining volume from said air pump and a second filter covering said air pump.

5. The central vacuum system according to claim 1, further including a stop means mounted on said housing for engaging said counterweight to prevent said cover from rotating beyond a predetermined fully open position.

6. An automatic material dumping system for a central vacuum system in which material is collected in a housing, which comprises:

a disposal opening in a lowermost end of said housing;

cover means for closing said disposal opening;

hinge means mounted on said housing adjacent to said disposal opening;

cover means for closing said disposal opening, said cover means secured to said hinge means and extending in a first direction;

an arm extending from said hinge means in a second direction; and a counterweight on said arm for maintaining said cover over said disposal opening when less than a predetermined weight of material rests on said cover within said housing, from about 60 to 100 per cent of said counterweight extends above said arm and said counterweight is spaced from said hinge a predetermined distance such that said counterweight will pass partially above said hinge as said cover is opening to lessen the cover closing force as said cover approaches a fully open position, whereby as material accumulates in said housing on said cover, when said predetermined weight is exceeded and said air pump means is turned off said cover will pivot downwardly to dump accumulated material.

7. The automatic material dumping system according to claim 6 further including:

an extension fastened to one of said cover and said arm, extending adjacent to said housing;

a fitting on said housing closely adjacent to said extension when said cover is closed; and a magnet mounted on one of said extension and fitting and in contact with the other and the other of said extension and fitting being formed from a magnetic material;

whereby magnetic attraction in the cover closed position will aid in maintaining said cover in said closed position until said predetermined weight has accumulated on said cover.

8. The automatic material dumping system according to claim 6, further including a stop means mounted on said housing for engaging said counterweight to prevent said cover from rotating beyond a predetermined fully open position.

9. In a central vacuum system for collecting hair during cutting of hair from a human or animal in which the system includes a housing, a plurality of inlet conduits for connection between hair cutting implements and said housing, air pump means for drawing air containing hair clippings into said housing and means for removing accumulated hair clippings from said housing, the improvement comprising:

a disposal opening in a lowermost side of said housing;

cover means for closing said disposal opening;

hinge means mounted on said housing with said cover extending from said hinge means in a first direction for covering said disposal opening;

an arm extending from said hinge means in a second direction; and a counterweight on said arm for maintaining said cover over said disposal opening to maintain said disposal opening closed when less than a predetermined weight of material rests on said cover within said housing, from about 60 to 100 per cent of said counterweight extends above said arm and said counterweight is spaced from said hinge a predetermined distance such that said counterweight will pass partially above said hinge as said cover is opening to lessen the cover closing force as said cover approaches a fully open position;

whereby as material accumulates in said housing on said cover, when said predetermined weight is exceeded and said air pump means is turned off said cover will pivot downwardly to dump accumulated material.

10. The improvement according to claim 9 further including:

an extension fastened to one of said cover and said arm, extending adjacent to said housing;

a fitting on said housing closely adjacent to said extension when said cover is closed; and a magnet mounted on one of said extension and fitting and in contact with the other and the other of said extension and fitting being formed from a magnetic material;

whereby magnetic attraction in the cover closed position will aid in maintaining said cover in said closed position until said predetermined weight has accumulated on said cover.

11. The improvement according to claim 9, further including a stop means mounted on said housing for engaging said counterweight to prevent said cover from rotating beyond a predetermined fully open position.

* * * * *